United States Patent [19]

Yoon

[11] Patent Number: 4,825,027

[45] Date of Patent: Apr. 25, 1989

[54] MICROWAVE OVEN DOOR LATCH ASSEMBLY

[75] Inventor: Chu H. Yoon, Changwon, Rep. of Korea

[73] Assignee: Goldstar Co., Ltd., Seoul, Rep. of Korea

[21] Appl. No.: 101,447

[22] Filed: Sep. 28, 1987

[51] Int. Cl.[4] ..... H05B 6/76

[52] U.S. Cl. ..... 219/10.55 C; 219/10.55 D; 126/197; 200/50 A

[58] Field of Search ..... 219/10.55 C, 10.55 D, 219/10.55 R; 200/50 A, 50 C, 61.62; 126/197

[56] References Cited

U.S. PATENT DOCUMENTS

| | | | |
|---|---|---|---|
| 4,006,121 | 2/1977 | Isono | 219/10.55 C X |
| 4,450,335 | 5/1984 | Shimizu et al. | 219/10.55 C |
| 4,596,914 | 6/1986 | Morino | 219/10.55 R X |
| 4,638,137 | 1/1987 | Kazumi | 219/10.55 C X |
| 4,663,505 | 5/1987 | Drake | 219/10.55 C |
| 4,672,160 | 6/1987 | Katoh | 219/10.55 C |

*Primary Examiner*—Philip H. Leung

*Attorney, Agent, or Firm*—Rosen, Dainow & Jacobs

[57] ABSTRACT

A door latch assembly for use in a microwave oven has a latch pawl coacting with a support member to lock or release a door of the oven. A wormgear having a switching wheel fixedly mounted thereon engages a worm driven by a motor controlled by primary and secondary switches both wired in parallel.

9 Claims, 2 Drawing Sheets

MICROWAVE OVEN DOOR LATCH ASSEMBLY

FIELD OF THE INVENTION

This invention relates to a latch assembly and particularly to the improvements in a latch assembly used in a microwave oven.

BACKGROUND OF THE INVENTION

A known latch assembly used in a microwave oven has customarily comprised a plurality of component parts of the latch assembly for assuring very little leakage of the microwave energy during operation of the oven. The construction of latch assembly necessitated the high cost because of the expensive component parts of it.

This latch assembly has numerous disadvantages inclusive of the following; it is easily unlatched by some shocks to the oven even during operation of the oven causing leakage of the microwave energy; and the operation of the push-button for opening the door requires a considerable manual force.

SUMMARY OF THE INVENTION

An object of this invention is to provide an electric latch assembly that operates easily and effectively with a minimum of manipulation and manual force.

A further object of this invention is to provide an electric latch assembly for assuring that a door is properly closed so that there is no leakage of the microwave energy during operation of the oven.

A still further object of the present invention is to provide an electric latch assembly for use in a microwave oven, which can be constructed easily with a low cost by virtue of its simple construction.

In accordance with the objects of this invention the electric latch assembly comprises a latch pawl fastened inside the door, a worm gear having a wheel formed thereon which wheel has one or more peripheral notches and one or more elongated protruding portions formed thereon, and a worm with a driving motor.

BRIEF DESCRIPTION OF THE DRAWINGS

These and other objects and advantages and further description will now be discussed in connection with the drawings in which:

FIG. 3-B is similar to FIG. 3-A but in the unlatched position; and

DETAILED DESCRIPTION OF THE INVENTION

Figure 1:
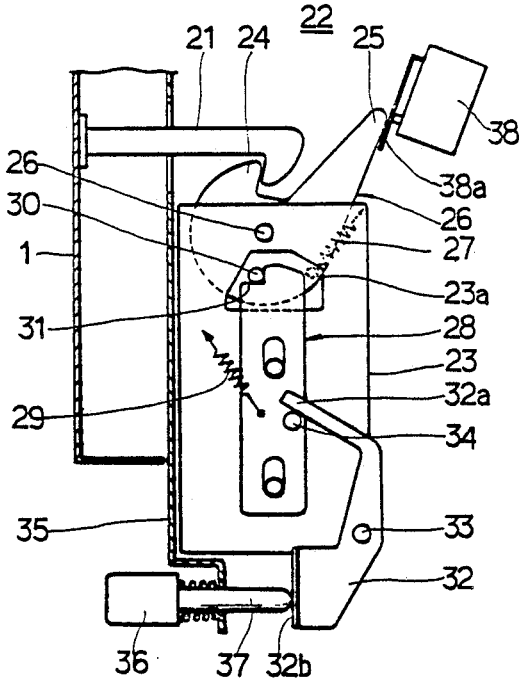
FIG.1 PRIOR ART
FIG. 1 is a side elevation view of a known latch assembly.

Referring to FIG. 1, a conventional latch assembly comprises a latch pawl 21 fixedly secured to the interior surface of the door 1 by means of such a securing means as welding. Behind and attached to the front face 35 is a rectangular support member 23 having a trapezoid-shaped hole 23*a*. An upward and downward movable lever 28 having a cutout portion 31 on which a support pin 30 will be hanged is mounted on the rectangular support member 23. A revolving plate 26 having a hook-shaped projection 24 and a projected bar 25 is pivotally secured to the rectangular support member 23 by a shaft 26*a*. A rotatable lever 32 is pivotally secured by a shaft 33 having one end 32*a* over a pin 34 of the up and down movable lever 28 and the other end 32*b* contacted with a bar 37 of a push-button switch 36. A spring 29 is bias located between the support member 23 and the movable lever 28 and a spring 27 between the support member 23 and the revolving plate 26.

In the prior art embodiment illustrated, upon pushing the push-button switch 36 the rotatable lever 32 will push the pin 34 downwardly causing the up and down movable lever 28 to move downwardly, thereby a stop pin 30 will be removed from the cut-out portion 31 and then the revolving plate 26 will rotate anti-clockwise by the force applied by the spring 27.

The known latch assembly described in the above has some disadvantages previously mentioned. Accordingly, to overcome such disadvantages, this invention discloses and claims a variation of such known latch assembly.

Figure 2:
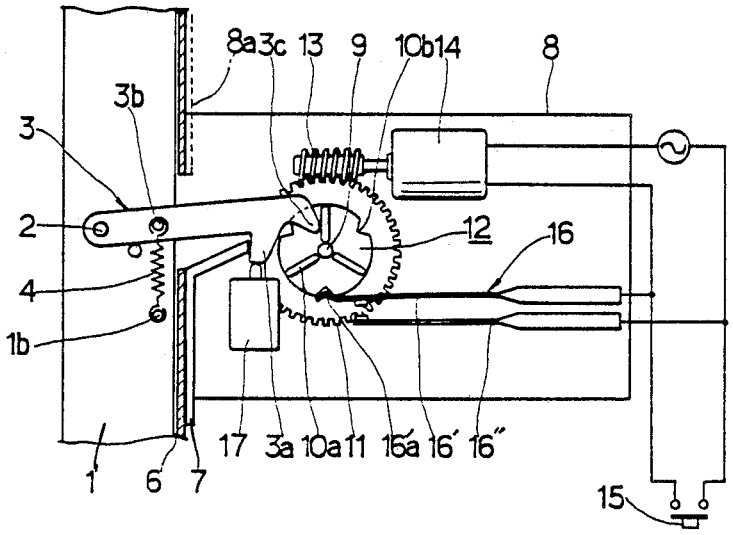
FIG. 2 is a side elevation of a latch assembly of the present invention.

Referring now to FIG. 2, there are provided a latch pawl 3 having a downwardly depending hook projection 3*a* and a depending hook projection 3*c* pivotally secured to the inside of the door 1 by the shaft 2. A coil spring 4 is longitudinally positioned inside the door 1 having one end hanged on a spring hanger member 3*b* formed on the latch pawl 3 and the other end secured to the other spring hanger member 1*b* formed inside the door. Behind and secured to the front face 6 is an obtuse support member 7.

A rectangular support member 8 having a curved end portion 8*a* is secured to the front face 6 of the oven. A worm gear 11 with a switching wheel 12 is rotatably mounted on the rectangular support member 8 by a shaft 9. The wheel 12 having one or more notches 10*b* formed in the periphery and elongated protruding portions 10*a* formed thereon is fixedly mounted on the worm gear 11. A driving motor 14 rotating only in the one direction and having a worm 13 is secured to the rectangular support member 8. The front face 6 has a push-button switch 15 accessible to the user from the outside of the oven.

A secondary elastic switch 16 having a movable terminal 16' having an upside-down V-shaped bent end 16'*a* and a fixed terminal 16'' is secured to the support member 8. The secondary switch 16 is connected parallel with the push-button switch 15 for operating the driving motor 14. A safety switch 17 is for permitting the energization of the microwave energy generating device.

Figure 3A:
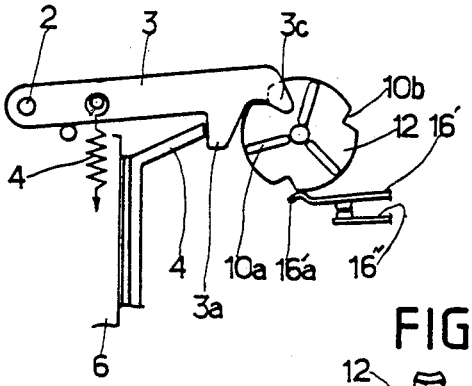
FIG. 3-A is a view of a component of the latch assembly of the present invention in the latched position.
Figure 3B:
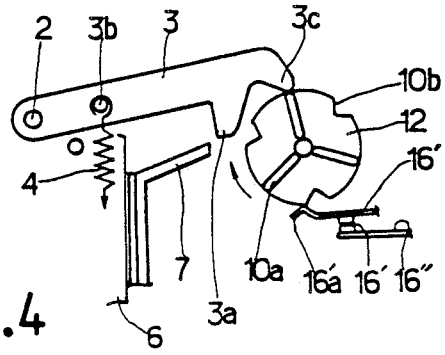
Figure 4:
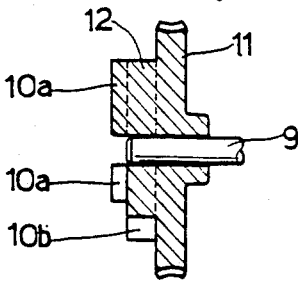
FIG. 4 is a cross-sectional view of a component of the latch assembly of the present invention taken along a plane indicated by line 4—4 of FIG. 2.

By this arrangement a slight touch of the primary switch 15 allows the driving motor 14 and the worm 13 to be rotated in unison forcing the worm gear 11 to be rotated and then the wheel rotates to a limited range allowing the upside-down V-shaped bent portion 16'*a* to be removed from the notch 10*b*. Upon removal from the notch 10*b* the movable terminal 16' is connected with the fixed terminal 16'', thereby the driving motor 14 continues to drive even when the switch 15 is released as clearly shown in FIG. 3A.

Upon continued driving of the driving motor 14 the elongated protruding portion 10*a* moves the depending hook projection 3*c* upwardly to an unlatching position. After the door is opened, the bent end 16'*a* is inserted to the next notch 10*b* and thus the two terminals 16′, 16″ return to the separated position from each other.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. In a microwave oven having a housing, a door and a door latch assembly, said door latch assembly including a pawl-engaging means secured to said housing and a pawl secured to said door that co-acts with said pawl-engaging means to lock or release said door, the improvement in said door latch assembly comprising a worm coupled to a drive motor mounted to said housing, a primary electrical switch in circuit with said drive motor for activating same, a secondary electrical switch wired in parallel with said primary electrical switch and having one terminal which is movable for maintaining said circuit temporarily closed, a switching wheel having at least one first element thereon for releasably engaging said pawl, said switching wheel being rotatably mounted in said housing, a worm gear fixed to and rotatable with said switching wheel and engaging said worm, said switching wheel having at least one second element thereon for releasably engaging said terminal of said secondary electrical switch for activating same, said primary electrical switch when actuated starting said drive motor and worm to rotate said worm gear and switching wheel, rotation of said switching wheel driving said terminal of said secondary electrical switch to actuate same and maintain said circuit in closed condition even after said primary electrical switch is deactivated with further rotation of said switching wheel causing said at least one first element thereon to engage and drive said pawl from its engagement with said pawl-engaging means and thereby release said door to open.

2. Apparatus according to claim 1, wherein said primary electrical switch is operable by a slight touching pressure, said secondary electrical switch comprising an elastic plate switch which slidably engages a circumferential surface and one of said second elements of said switching wheel.

3. Apparatus according to claim 1 wherein said at least one first element on said switching wheel comprises a radially extending projection.

4. Apparatus according to claim 1 wherein said switching wheel has three of said first element which are equally spaced circumferentially, each said first element being a radially extending projection.

5. Apparatus according to claim 1 wherein said at least one second element on said switching wheel comprises a notch extending generally radially inward, and wherein said terminal is a flexible strip having a projection for engaging said notch, said secondary electrical switch being open when the projection is in the notch and being closed when said switching wheel rotates and drives said projection out of said notch.

6. Apparatus according to claim 5 wherein said switching wheel has three equally-spaced said notches around the periphery thereof and wherein said projection in said terminal rides in and out of said notch during rotation thereof.

7. Apparatus according to claim 1 further comprising first spring means urging said pawl toward a first position wherein said pawl is urged toward said pawl-engaging means for latching said door in closed condition.

8. Apparatus according to claim 1 wherein said primary and secondary electrical switches are biased toward open condition until activated.

9. Apparatus according to claim 1 wherein said pawl has a first projection for engaging said pawl-engaging means and a second projection for engaging one of said at least one first element on said switching wheel.

* * * * *